US009863093B2

(12) United States Patent
Imppola et al.

(10) Patent No.: US 9,863,093 B2
(45) Date of Patent: Jan. 9, 2018

(54) PLY FOR A BOARD FROM AN IN-LINE PRODUCTION PROCESS

(71) Applicants: Stora Enso Oyj, Helsinki (FI); Wetend Technologies Ltd., Savonlinna (FI)

(72) Inventors: Olavi Imppola, Hyvinkaa (FI); Jouni Matula, Savonlinna (FI); Jussi Matula, Savonlinna (FI); Karri Tahkola, Savonlinna (FI); Matti Vakevainen, Imatra (FI); Isto Heiskanen, Imatra (FI); Jari Rasanen, Imatra (FI)

(73) Assignees: Stora Enso OYJ, Helsinki (FI); Wetend Technologies Ltd., Savonlinna (FI)

( * ) Notice: Subject to any disclaimer, the term of this patent is extended or adjusted under 35 U.S.C. 154(b) by 3 days.

(21) Appl. No.: 14/441,257

(22) PCT Filed: Nov. 6, 2013

(86) PCT No.: PCT/IB2013/059944
§ 371 (c)(1),
(2) Date: May 7, 2015

(87) PCT Pub. No.: WO2014/072912
PCT Pub. Date: May 15, 2014

(65) Prior Publication Data

US 2015/0315748 A1 Nov. 5, 2015

(30) Foreign Application Priority Data

Nov. 9, 2012 (SE) ..... 1251279

(51) Int. Cl.
*D21H 17/67* (2006.01)
*D21H 11/18* (2006.01)
(Continued)

(52) U.S. Cl.
CPC ..... *D21H 17/675* (2013.01); *D21H 11/18* (2013.01); *D21H 17/25* (2013.01); *D21H 17/67* (2013.01); *D21H 17/70* (2013.01)

(58) Field of Classification Search
CPC ..... D21H 11/18; D21H 17/25; D21H 17/675; D21H 17/70; D21H 17/67; D21H 17/63; D21H 23/04; D21H 23/00
See application file for complete search history.

(56) References Cited

U.S. PATENT DOCUMENTS 8,852,402 B2 * 10/2014 Imppola ..... D21H 17/70 162/181.2
9,157,189 B2 * 10/2015 Heiskanen ..... D21H 11/18
(Continued)

FOREIGN PATENT DOCUMENTS

EP 0935020 8/1999
EP 1219344 7/2002
(Continued)

OTHER PUBLICATIONS

European Patent Office, Extended European Search Report, PCT/IB2013/059944, dated May 3, 2016.
(Continued)

*Primary Examiner* — Jose Fortuna
(74) *Attorney, Agent, or Firm* — Greer, Burns & Crain, Ltd.

(57) ABSTRACT

A ply for a paper and paperboard made from a ply substrate material, wherein the ply comprises a hybrid material, in an amount of 1-25 wt-% of the ply, wherein the hybrid material is introduced into a target suspension of the short circulation of a fibrous web forming process of a fibrous web machine, in an in-line process, wherein said target suspension forms the ply substrate material, and the hybrid material comprises
(Continued)

an alkaline earth carbonate precipitated onto or into fibers or fibrils of a nanofibrillated polysaccharide.

8 Claims, 3 Drawing Sheets

(51) Int. Cl.
*D21H 17/25* (2006.01)
*D21H 17/70* (2006.01)

(56) References Cited

U.S. PATENT DOCUMENTS 9,181,103 B2 * 11/2015 Imppola ..... C01F 11/02
9,453,305 B2 * 9/2016 Imppola ..... D21H 11/18
9,562,328 B2 * 2/2017 Axrup ..... C08K 3/26
9,605,382 B2 * 3/2017 Virtanen ..... D21H 17/28
2010/0279019 A1 11/2010 Beck et al.
2011/0000633 A1 * 1/2011 Kukkamaki ..... C01F 11/181 162/181.2
2012/0080156 A1 4/2012 Laleg et al.
2012/0318471 A1 * 12/2012 Turkki ..... D21H 23/04 162/181.3
2013/0062030 A1 * 3/2013 Imppola ..... D21H 17/70 162/181.4
2013/0216468 A1 * 8/2013 Imppola ..... C01F 11/02 423/432
2013/0292079 A1 * 11/2013 Kukkamaki ..... C01F 11/181 162/232
2015/0292159 A1 * 10/2015 Imppola ..... D21H 11/18 162/177
2015/0299959 A1 * 10/2015 Axrup ..... C08K 3/26 162/181.4
2015/0315747 A1 * 11/2015 Heiskanen ..... D21H 11/18 162/181.2
2015/0315748 A1 * 11/2015 Imppola ..... D21H 11/18 162/157.7
2016/0038897 A1 * 2/2016 Matula ..... B01F 5/0405 366/182.2
2016/0060813 A1 * 3/2016 Heiskanen ..... D21H 17/63 162/168.3
2016/0153144 A1 * 6/2016 Hiltunen ..... C08B 15/02 162/9
2016/0201265 A1 * 7/2016 Kosonen ..... D21H 11/18 162/175
2017/0067208 A1 * 3/2017 Backfolk ..... D21H 13/12
2017/0107669 A1 * 4/2017 Axrup ..... D21H 17/675

FOREIGN PATENT DOCUMENTS

EP 2287398 2/2011
FI EP 2486188 B1 * 5/2016
WO 2005033403 4/2005
WO 2006008333 1/2006
WO 2009021687 2/2009
WO 2009103854 A2 8/2009
WO 2010125247 11/2010
WO 2011004300 1/2011
WO 201104207 4/2011
WO 2011042607 4/2011
WO 2011098672 8/2011
WO 2011110744 9/2011
WO 2011154610 12/2011
WO 2012039668 3/2012

OTHER PUBLICATIONS

Miskiel, F J et al., "Use of High Amylose Corn Starch to Improve the Increase in Paper Strength Attained by Addition of Microfibrillated Cellulose," Research Disclosure, Dec. 1, 1999, 42806, Mason Publications, Hampshire, GB, ISSN 0374-4353, XP007125106.
International Searching Authority, Written Opinion of the International Searching Authority, PCT/IB20013/059944, dated Feb. 13, 2014.
International Searching Authority, International Search Report, PCT/1620013/059944, dated Feb. 13, 2014.
Patent Cooperation Treaty, International-Type Search Report, SE1251279-4, dated Jun. 4, 2013.

* cited by examiner

PLY FOR A BOARD FROM AN IN-LINE PRODUCTION PROCESS

This application is a U.S. National Phase under 35 U.S.C. §371 of International Application No. PCT/IB2013/059944, filed Nov. 6, 2013, which claims priority under 35 U.S.C. §§119 and 365 to Swedish Application No. 1251279-4, filed Nov. 9, 2012.

TECHNICAL FIELD

The present document relates to a ply for a paper or paperboard comprising a hybrid material, produced through a method for an inline production method in a paper making process.

BACKGROUND

Fillers are added to a papermaking pulp to fill void spaces not occupied with the fibres and thus to smoothen the surface of paper. They improve for example paper printability, dimensional stability, formation, and gloss. Added to this, optical paper properties like opacity, light scattering, and brightness are usually improved, because fillers' light scattering coefficient and brightness that are often higher than those of pulp.

Fillers are low-priced when comparing to wood fibers and thus also used in a paper manufacturing to reduce the costs of papermaking raw materials. Also drying of the filler-bearing paper web requires less energy. In spite of their inexpensive price and positive effects to paper properties, fillers have also negative features. They interfere inter-fiber bonding by adsorbing or precipitating on fiber surfaces. Because of this, paper tensile strength and tensile stiffness are reduced and linting can appear in printing. Also abrasion on paper machine can increase because of fillers. Their retention is usually quite poor and it can cause two-sidedness on paper.

In packaging board grades, fillers are not typically used or used in a very low amounts compared to other paper grades. Typical reasons for this are that they increase weight of the board without giving strength properties and that they reduce calibre in the same grammage. Calibre is most important parameter for bending stiffness. Also the fillers reduce elastic modulus, which is an important parameter for bending stiffness.

High brightness bleached pulp is quite often used in the top ply of the board. Target with this is to have higher brightness and generally improved appearance of the board. Even on such cases only very low filler amounts are used and typically quite expensive fillers, such as TiO2, calcined kaolin etc., are used to optimize elastic modulus of the top ply and maximize board bending stiffness. Quite often top ply grammage is optimized against whiteness and visual appearance instead of optimizing it against maximal bending stiffness.

Thus there would be a high need to improve whiteness and opacity of the board top ply with maintaining board bending stiffness and same time use low cost fillers.

One quite typical filler used in paper making is precipitated calcium carbonate (PCC). Typically the production of PCC has been produced separately from the actual paper making process. PCC is normally produced at a dedicated plant located close the paper mill.

In WO 2011110744, a method and a reactor for in-line production of calcium carbonate (PCC) in connection with the production process of a fibrous web is disclosed. This relates to in-line production of FCC into a suspension to be used in the production of the fibrous web, especially preferably directly into the flow of fibrous pulp, one of its partial pulp flows or a filtrate flow used in the production of fibrous pulp. This method has several advantages as reduced investment costs, since there is no need to have a separate PCC plant. Further there is a reduced need of retention chemicals as FCC is at least partially precipitated directly onto fibres.

In EP2287398A1 a method for obtaining a calcium carbonate, possibly fibers and fiber fibril containing composite is obtained in which the calcium carbonate particles, if needed with the fibrils and fibers are connected, which is characterized by good dewatering capability and which for the manufacture of paper with a large amount of filler, with a great strength and having a large specific volume. This invention is achieved by the combination of five measures, the use of specific calcium carbonate particles, which is ($d_{50}$) and has a scalenohedral morphology and an average particle diameter of more than 2, 5 μm and a maximum of 4 μm, by the setting of a weight ratio of fibrils to calcium carbonate in the suspension before the coprecipitation of 0.2:1 to 4:1, by the use of fiber fibrils and through the setting of a weight ratio of calcium carbonate into the fibrils before the coprecipitation of 0.02:1 to 0.2:1. However this method describes a traditional off-line precipitated calcium carbonate process using carbon dioxide and milk of lime.

There is thus a need for a new ply for a paper or paperboard and a process for the production of said board ply having a desirable visual appearance, but also an optimized elastic modulus.

SUMMARY

It is an object of the present disclosure, to provide an improved ply for a paper or paperboard which eliminates or alleviates at least some of the disadvantages of the prior art plies.

The object is wholly or partially achieved by a ply and a method according to the appended independent claims. Embodiments are set forth in the appended dependent claims, and in the following description and drawings.

According to a first aspect, there is provided a ply for a paper and paperboard made from a ply substrate material, wherein the ply comprises a hybrid material, in an amount of 1-25 wt-% of the ply. The hybrid material is formed when introduced into a target suspension of the short circulation of a fibrous web forming process of a fibrous web machine, in an in-line process, wherein said target suspension forms the ply substrate material, and the hybrid material comprises an alkaline earth carbonate precipitated onto or into fibers or fibrils of a nanofibrillated polysaccharide. The nanofibrillated polysaccharide is a microfibrillated cellulose.

According to the first aspect the ply may comprise the hybrid material in an amount of 1 to 15 wt-%.

The alkaline earth carbonate may be any one of a calcium carbonate, a magnesium carbonate and a combination of a calcium and magnesium carbonate.

According to one embodiment the alkaline earth carbonate may be a calcium carbonate.

According to yet an embodiment of the first aspect.

The hybrid material may thus be formed by a calcium carbonate precipitated onto or into the fibers or fibrils of the microfibrillated cellulose (MFC). Said calcium carbonate may be added and formed into the target suspension as disclosed in WO 2011/110744 A2. The calcium carbonate may according to this method be formed or precipitated directly onto the surface of the MFC. The precipitated calcium carbonate may therefore be a so called PCC filler. The target suspension thus forms the ply substrate material or composition with the PCC filler formed therein and directly onto or into the fibers or fibrils of the MFC.

The nano-och microfibrillated cellulose may be obtained through conventional methods such as mechanical liberation of fibrils or by acid hydrolysis of cellulosic materials, e.g. disclosed in WO 2009021687 A1, or MFC suspension produced by enzymatic hydrolysis of Kraft pulp cellulose following a mechanical treatment step, e.g. disclosed in WO2011004300 A1, acid hydrolysis followed by high pressure homogenization, e.g. disclosed in US20100279019, or by any other means known to the skilled person. The concentration of MFC in such suspensions is usually about 1-6 wt-% and the remaining part is water and/or additives used to improve the production or to modify the MFC.

According to one embodiment of the first aspect said calcium carbonate may be added or formed, and precipitated into the ply substrate material through an in-line process and into a target suspension of a fibrous web forming process of a fibrous web machine, substantially simultaneously with a suitable amount of an aqueous suspension of a microfibrillated cellulose.

Usage of microfibrillated cellulose/nanocellulose has been studied in paper making quite widely. It has been found out that even though MFC improves strength properties (including elastic modulus—important for board top ply), it reduced porosity and increased drying shrinkage at the same time. These, however, have negative effects on board making in the fact that the top ply porosity is reduced due to the addition of MFC, which leads to a risk of blowing or blistering. Drying will form steam inside of the board and as this steam cannot escape fast enough due to reduced porosity, the board will be easier delaminated.

By combining the so called in-line PCC process (i.e. dosing of calcium carbonate or carbon dioxide and milk of lime) with a simultaneous dosing or introduction of MFC several improvements in top ply properties have been observed. This method allows for the incorporation of a hybrid material, comprising for instance calcium carbonate precipitated onto the fibers or fibrils of a microfibrillated cellulose, into the ply. This allows for an increased whiteness of ply of the board and also decrease cloudiness of white surface and an increased of the ply smoothness.

This further allows for an increase in elastic modulus in the same porosity and improved whiteness of the ply.

By using in-line PCC there may be provided for reduced costs for process chemicals, and an increased board machine process purity, such as less web brakes, less dirty spots, no accumulations on pipelines.

It has surprisingly been found that precipitation of the PCC particles happens most likely on the surface of fine particles that exists in the process waters, which is related to the surface energy, high surface area and pH properties of these fine particles.

By introducing the microfibrillated cellulose or "nanocellulose" (MFC) into the milk lime of the in-line calcium carbonate process the amount of fines needed to obtain a satisfactory whiteness and visual appearance while still being able to control the drying shrinkage and maintain the improvement in elastic modulus may be easily controlled, in that the larger part of the calcium carbonate is precipitated onto/into MFC.

Thus by introducing, or dosing, MFC into an in-line PCC process there is provided a way to control the amount of fines needed, as the surface pH and chemistry of the MFC can be adjusted, and thus, the particle size and dimensions of the PCC that is introduced into the fiber flow or target suspension may be controlled, this means that the quality of the ply substrate material can be controlled and improved in this manner.

Also by having the PCC particles onto the MFC surface the porosity of the ply may be controlled, the drying shrinkage can be controlled and the improved elastic modulus provided by the MFC may be maintained. By having the PCC particles on the ply, whiteness and printability may be improved without reduced bending stiffness.

Since in-line PCC is a relatively cheap filler the costs of the board may be reduced, in relation to using more expensive fillers.

There is also an increased cleanliness of the ply and board making machine.

The ply according to the first aspect may be any one of a top and bottom ply for a board.

According to one embodiment of the first aspect the target suspension of the fibrous web forming process may comprise at least one of the following components: virgin pulp suspension (long-fiber pulp, short-fiber pulp, mechanical pulp, chemo mechanical pulp, chemical pulp, microfiber pulp, nanofiber pulp), recycled pulp suspension (recycled pulp, reject, fiber fraction from the fiber recovery filter), additive suspension and solids-containing filtrate and forming the ply substrate material.

According to a second aspect there is provided an in-line production method for providing a hybrid material for a ply for a board, the method comprising the following steps (i) providing a liquid flow of an alkaline earth carbonate or at least one precursor thereof, in a target suspension, of the short circulation and into the liquid flow of a paper making stock of a fiber web machine by feeding the liquid flow of said alkaline earth carbonate or at least one precursor thereof to the liquid flow of the short circulation, said target suspension forming a ply substrate material; and (ii) providing a suitable amount of a nanofibrillated polysaccharide substantially simultaneously with the feeding of liquid flow of the alkaline earth carbonate or at least one precursor thereof, thereby forming a hybrid material, wherein the hybrid material comprises said alkaline earth carbonate precipitated onto or into fibers and/or fibrils of said nanofibrillated polysaccharide.

According to the second aspect the alkaline earth carbonate may a precipitated calcium carbonate, formed from a reaction between two precursor materials, said precursor materials being carbon dioxide and lime milk, wherein said carbon dioxide and lime milk being fed to the short circulation substantially simultaneously.

By "lime milk" is also meant hydrated lime, builders lime, slack lime, or pickling lime.

Further, the feeding into the short circulation may performed by injecting the alkaline earth carbonate or precursor materials and/or nanofibrillated polysaccharide into the target suspension of the liquid flow of the paper making stock.

According to one embodiment of the second aspect the feeding into the short circulation may be performed by injecting at least either carbon dioxide, lime milk and/or microfibrillated cellulose into the target suspension of the liquid flow of the paper making stock.

The wherein the carbon dioxide, lime milk and/or microfibrillated cellulose may be fed separately by injection.

The microfibrillated cellulose may further be provided in the liquid flow of a paper making stock and the lime milk and carbon dioxide may be fed separately or simultaneously by injection.

According to one alternative the lime milk and microfibrillated cellulose may be mixed prior to the injection into the liquid flow of a paper making stock and the carbon dioxide may be fed separately from the lime milk and microfibrillated cellulose mixture.

According to another alternative the microfibrillated cellulose may be mixed with other optional additives and the mixture may be fed separately from the feeding of lime milk and carbon dioxide.

According to yet an alternative of the second aspect the injection into the liquid flow of a paper making stock may be performed from one more several nozzles in a direction substantially transverse to the direction of the liquid flow, and at a flow rate that is higher than that of the liquid flow.

The liquid flow of paper making stock may comprise at least one of the following components: virgin pulp suspension (long-fiber pulp, short-fiber pulp, mechanical pulp, chemo mechanical pulp, chemical pulp, microfiber pulp, nanofiber pulp), recycled pulp suspension (recycled pulp, reject, fiber fraction from the fiber recovery filter), additive suspension and solids-containing filtrate.

BRIEF DESCRIPTION OF THE DRAWINGS

Embodiments of the present solution will now be described, by way of example, with reference to the accompanying schematic drawings.

DESCRIPTION OF EMBODIMENTS

Definition of Nanofibrillated Polysaccharide

Figure 1:
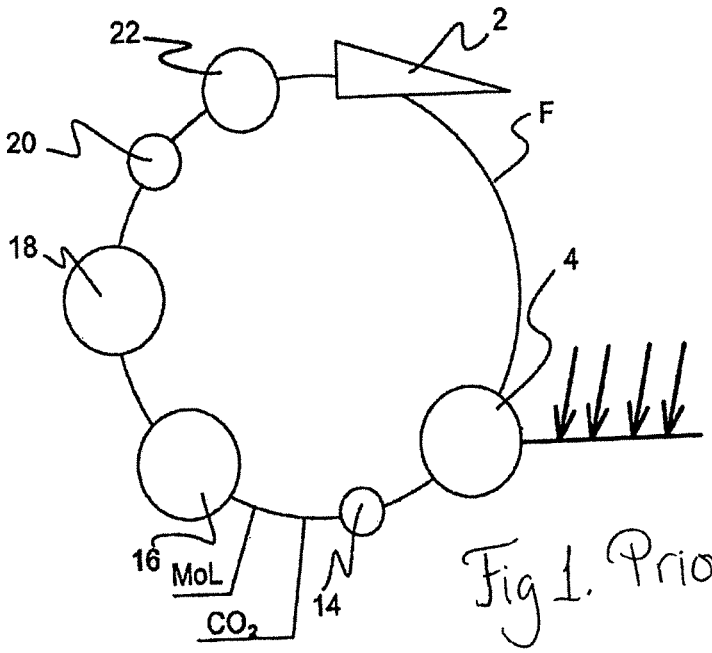
Fig 1. Prior Art
FIG. 1 shows schematically a short circulation arrangement according to prior art.

This definition includes bacterial cellulose or nanocellulose spun with either traditional spinning techniques or then with electrostatic spinning. In these cases, the material is preferably a polysaccharide but not limited to solely a polysaccharide.

Also whiskers, microcrystalline cellulose or regenerated cellulose and nanocellulose crystals is included in this definition.

Definition of Microfibrillated Cellulose

The microfibrillated cellulose (MFC) is also known as nanocellulose. It is a material typically made from wood cellulose fibers, both from hardwood or softwood fibers. It can also be made from microbial sources, agricultural fibers such as wheat straw pulp, bamboo or other non-wood fiber sources. In microfibrillated cellulose the individual microfibrils or elementary fibrils have been partly or totally detached from each other. A microfibrillated cellulose fibril is normally very thin (~20 nm) and the length is often between 100 nm to 10 μm. However, the microfibrils may also be longer, for example between 10-200 μm, but lengths even 2000 μm can be found due to wide length distribution. Fibers that has been fibrillated and which have microfibrils on the surface and microfibrils that are separated and located in a water phase of a slurry are included in the definition MFC. Furthermore, whiskers are also included in the definition MFC.

Even though it is known that microfibrillated cellulose (MFC) increase elastic modulus of paper, microfibrillated cellulose (MFC) is not good for top ply of board due to reduced porosity (poor porosity/elastic modulus ratio) and increased drying shrinkage.

However there is a need to increase whiteness of board grades, but this has not been possible previously efficiently with fillers due to reduction of elastic modulus. In duplex type boards (3 ply board with brown middle ply) this is done mainly with top ply grammage increase (and 3% filler).

Definition of Precipitated Calcium Carbonate (PCC)

Almost all PCC is made by direct carbonation of hydrated lime, known as the milk of lime process. Lime (CaO) and carbon dioxide, which can be captured and reused is formed in this process. The lime is slaked with water to form $Ca(OH)_2$ and in order to form the precipitated calcium carbonate (insoluble in water) the slaked lime is combined with the (captured) carbon dioxide. The PCC may then be used in paper industry as a filler or pigmentation, mineral or coating mineral or in plastic or barrier layers. It can also be used as filler in plastics or as additive in home care products, tooth pastes, food, pharmaceuticals, paints, inks etc.

Definition of in-Line Precipitated Calcium Carbonate Process

By "in-line production" is meant that the precipitated calcium carbonate (PCC) is produced directly into the flow of the paper making stock, i.e. the captured carbon dioxide is combined with slaked lime milk inline, instead of being produced separately from the paper making process. Separate production of PCC further requires the use of retention chemicals to have the PCC adsorbed or fixed onto the fibers. An in-line PCC process is generally recognized as providing a clean paper machine system, and there is a reduced need of retention chemicals. An in-line PCC process is for instance disclosed in WO2011/110744.

FIG. 1 shows a prior art method for inline production of precipitated calcium carbonate, as disclosed in US2011/0000633 and a schematic process arrangement for a paper making machine 2. The white water F, is carried to e.g. a mixing tank or filtrate tank 4, to which various fibrous components are introduced for the paper making stock preparation. From fittings at least one of virgin pulp suspension (long-fiber pulp, short-fiber pulp, mechanical pulp, chemomechanical pulp, chemical pulp, microfiber pulp, nanofiber pulp), recycled pulp suspension (recycled pulp, reject, fiber fraction from the fiber recovery filter), additive suspension and solids-containing filtrate is carried to the mixing tank, and from there conveyed by a mixing pump 14 to a vortex cleaner 16, where heavier particles are separated. The accept of the vortex cleaning continues to a gas separation tank 18, where air and/or other gases are removed from the paper making stock. The paper making stock is then transported to a feed pump 20 of the headbox, which pumps the paper making stock to a so-called headbox screen 22, where large sized particles are separated from the paper making stock. The accept faction is carried to the paper making machine 2 through its headbox. The short circulation of fiber web machines producing less demanding end products may, however, not have a vortex cleaner, gas separation plant and/or headbox.

In the prior art process the PCC production is performed in the short circulation of the paper making machine, before the vortex cleaning plant 16. The carbon dioxide ($CO_2$) is injected on the pressure side of the vortex cleaner and the lime milk (MoL) is injected a few meters after the carbon dioxide has dissolved in the same pipe. It is however conceivable that this PCC production could take place closer to the headbox, or that the distance between the injectors is very small, virtually injecting carbon dioxide and lime milk at the same location in the short circulation. This depends on the requirements of the end product and the design of the paper making machine.

According to the invention there is provided an inline production method where additives, such as carbon dioxide, milk lime etc., are fed into the short circulation of the paper making machine, i.e. into the fibrous web or paper making stock, and where a suitable amount of a microfibrillated cellulose, MFC, is provided substantially simultaneously as these additives are being fed into the short circulation.

What is meant by "substantially simultaneously" may vary as described below, however in this context it is to be understood that the MFC is provided such that the additive, such as e.g. PCC may be formed, i.e. crystallized onto or into the MFC.

Where two or more additives are fed into the short circulation these are preferably allowed to react with one another, which means that they are fed into the short circulation in a manner which allows for the additives to react, in the case of lime milk and carbon dioxide, such that precipitated calcium carbonate is formed onto or into the MFC.

According to one embodiment of the present invention, an in-line PCC process is combined with the dosage of MFC into the in-line PCC process. This provides for a completely new way of providing PCC to for instance a fibrous web in a paper making process.

Figure 2:
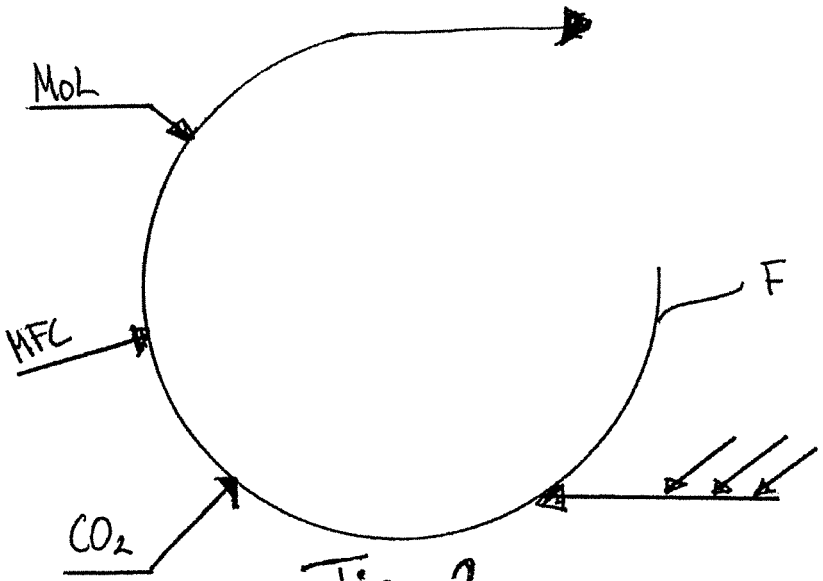
FIG. 2 shows schematically a short circulation arrangement according to one embodiment of the invention.

In one embodiment of the present invention, as shown in FIG. 2 lime milk, carbon dioxide and MFC are injected separately into the short circulation and fibrous web of the paper making machine.

Figure 3B:
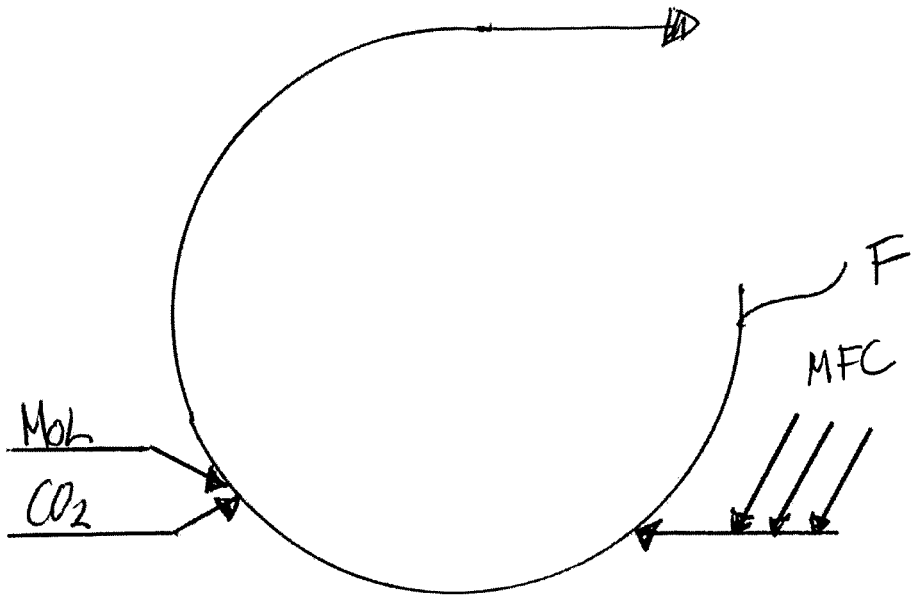
FIGS. 3*a-b* shows schematically a short circulation arrangement according to one alternative embodiment of the invention.
Figure 3A:
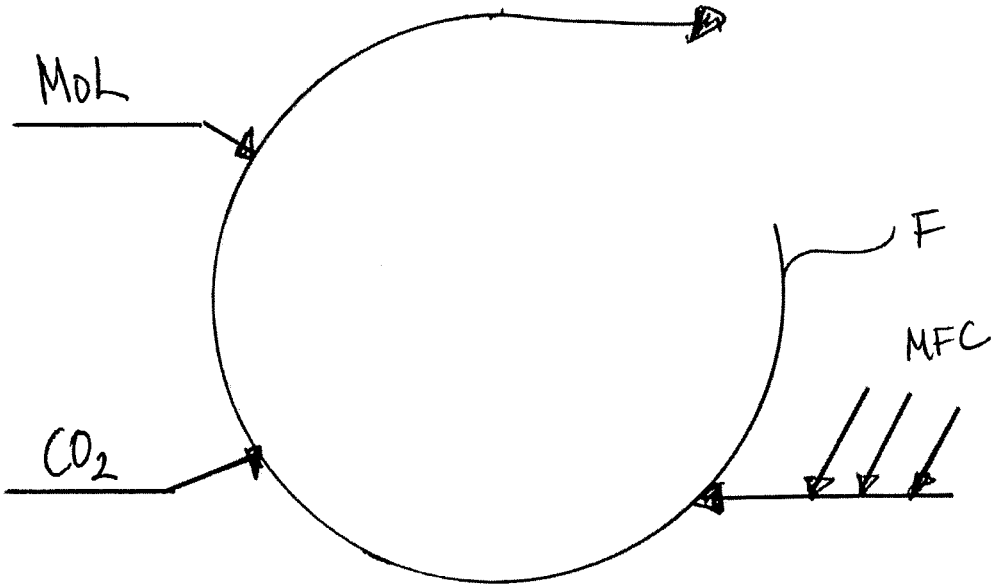

In an alternative embodiment, as shown in FIGS. 3*a* and 3*b* the MFC is provided e.g. in the preparation of the paper making stock, and thus is present in the paper making stock and the carbon dioxide and lime milk are injected separately (FIG. 3*a*) or simultaneously (FIG. 3*b*) into the short circulation.

Figure 4:
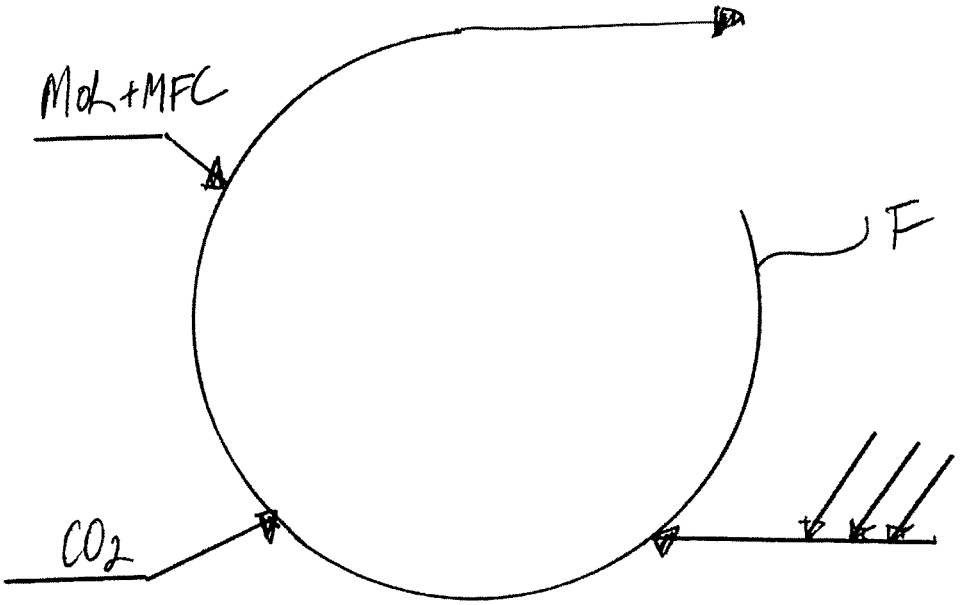
FIG. 4 shows schematically a short circulation arrangement according to yet an alternative embodiment of the invention.

In yet an alternative embodiment, as shown in FIG. 4 the lime milk and the MFC are mixed before the injection into the short circulation and the carbon dioxide is injected separately from this mixture.

Figure 5:
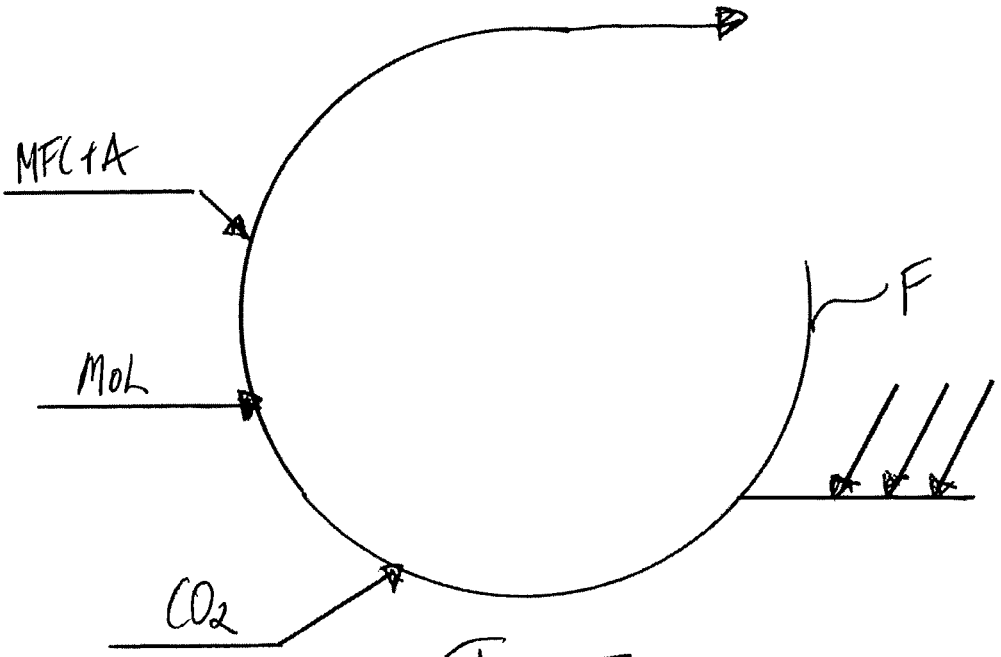
FIG. 5 shows schematically a short circulation arrangement according to yet another alternative embodiment of the invention

In yet another alternative embodiment the, as shown in FIG. 5, the MFC is mixed with other additives and this mixture is injected separately from the lime milk and carbon dioxide.

In all of the above described embodiments it is to be understood that the order of injection of the additives, i.e. lime milk, carbon dioxide, MFC and possibly other additives may occur in a different order or at a different stage in the short circulation. It is conceivable that the injection occurs very close to the headbox, or that the MFC is dosage prior to the addition of the carbon dioxide or that the distances between the "injection points" is shorter or longer than described above. Thus the MFC, lime milk and carbon dioxide may be injected into the short circulation substantially at the same injection point.

The point or point where the injection takes place thus forms a "PCC reaction zone".

According to one embodiment the MFC provides for an increased fiber surface area onto which the lime milk can adsorb and/or PCC may precipitate.

By modifying and adjusting the surface energy, reaction sites, pH and surface chemistry of the MFC there is provided a completely new way of controlling how the PCC crystals are formed on the surface of the MFC. The crystals formed on the surface of the MFC particle may take on different shapes and configurations.

By combining the in-line PCC process with a dosing or introduction of MFC there is provided a new way of controlling the paper making process without, e.g. modifying the entire white water circulation.

Further in the application of the fibrous web forming a top ply, several improvements have been observed, such as an increased whiteness of board and also decrease cloudiness of white surface and an increase of the board smoothness. There is also an increased elastic modulus in the same porosity and improved whiteness.

By using PCC there is a reduced cost for process chemicals, and an increase in board machine process purity, such as less web brakes, less dirty spots, no accumulations on pipelines.

In EP1219344 B1 there a method and apparatus which are particularly well applicable to homogeneous adding of a liquid chemical into a liquid flow are disclosed. In this method a mixer nozzle is utilized, and the liquid chemical is fed into the mixer nozzle and a second liquid is introduced into the same mixer nozzle, such that the chemical and second liquid are brought into communication with each other substantially at the same time as the chemical is discharged together with the second liquid from the mixer nozzle at high speed into the process liquid, and transverse to the process liquid flow in the flow channel. The chemical and second liquid may be discharged directly into the fiber suspension flowing towards the headbox of the paper machine. The second liquid may be a circulation liquid from the paper process, such as white water, or may be fresh water depending on the requirements of the liquid chemical to be added to the fiber flow. The flow speed from the mixer nozzle may be around five times the flow speed of the fiber suspension into which the chemical and second liquid is discharged.

By using this type of fast addition of the PCC and MFC there is provided a way of forming the PCC crystals on the MFC very quickly. This fast formation of the PCC crystals provides for new PCC-fiber complexes in which the PCC grows in a cubic formation around the strings and wires of the MFC. This provides for less steric hindrance and provides great strength for the structure. A further advantage of this new crystal formation is that it provides for a very clean process without any up-build of PCC in pipes etc.

Also as the PCC is formed around the MFC or nanocellulose, and is bound very tightly to the fibre the hazards of using such small particles as the MFC is greatly reduced.

According to one embodiment the amount of precipitated calcium carbonate in the ply is less than 25 wt-%, more preferred less than 15 wt-% and even more preferred less than 8 wt-% and most preferred below 6 wt-%.

EXAMPLE

A trial was performed in a pilot paper machine. Target of the trial was to simulate top ply of multi ply board.

Furnish was 100% bleached birch refined to 26 SR level. Running speed was 80 m/min and grammage 65 gsm. Conventional paper making chemicals used in board production were used, such as retention chemicals, hydrophobic sizing etc. These parameters were kept the same during the trial.

Table 1 below shows an overview of how the trials were performed and the chemicals used therein.

The addition of CMC (carboxymethyl cellulose) is not essential, however a slight improvement in strength could be noticed. CMC does however have negative effect on wire retention and brightness.

Starch is typically added as it gives some strength without major negative effects.

In EX1 mixing of MFC and starch to the milk of lime was done and that was dosage or introduced into the in-line PCC reactor, where $CO_2$ was also introduced for the formation of precipitated calcium carbonate, PCC directly into the short circulation.

In EX2 the MFC and starch were dosage to the mixing chest (thick stock) were only birch fibers are present and an in-line PCC reactor was used as it normally used (pure milk of lime was dosaged without any additives).

As a reference (REF1) an off-line PCC was used, which was produced and transported from a paper mill for these pilot trials. In REF2 (and EX1 and EX2) "in-line PCC" referrers to the PCC reactor, i.e. in the short circulation of the paper machine, into which pulp and white water goes just before centrifugal cleaners, but in REF2 no MFC was added.

TABLE 1

Overview of trials

| | | REF1 | REF2 | EX1 | EX2 |
|---|---|---|---|---|---|
| Filler level in end product | | Off-line PCC 5% | 7.50% | 7.50% | 7.50% |
| dosing place | | level box | PCCreactor | PCCreactor | PCCreactor |
| filler type | | PCC | Inline-PCC | Inline-PCC | Inline-PCC |
| CMC mixed to milk of lime and then cationic starch with T-bar when pumped | | | | | |
| CMC amount from filler (2.3 kg/t from paper) | | | | 3% | |
| starch amount from filler (2.3 kg/t from paper) | | | | 3% | |
| MFC to the milk of lime 2.3 kg/t of the end product (paper) | | | | | |
| MFC-amount from filler | | | | 3% | |
| Cationic starch | Mixing chest | | | | 20 kg/t |
| MFC | Mixing chest | | | | 20 kg/t |
| Grammage | g/m2 | 66.8 | 65.7 | 65.3 | 64.2 |
| Density | kg/m3 | 726 | 747 | 759 | 773 |
| Bulk | | 1.38 | 1.34 | 1.32 | 1.29 |
| Air resistance Gurley | s/100 ml | 11 | 11 | 15 | 31 |
| Brightness D65/10° + UV, bs | | 85 | 85.3 | 84.7 | 84.8 |
| Opacity C/2° + UV | % | 78.4 | 79.8 | 78.1 | 77.5 |
| Tensile stiffness index, geom | | 5.6 | 5.3 | 5.9 | 6.3 |
| Tensile index geom | | 51.4 | 45.9 | 54.2 | 58.8 |
| Burst index | | 3.1 | 2.6 | 3.4 | 3.8 |
| E-modulus, geom | | 4051 | 3942 | 4495 | 4870 |

From these trials is clear that it is not possible to replace the 5% off-line PCC with 7.5% in-line PCC because strength values goes down too much with regards to tensile strength, burst index etc.

It is possible to replace 5% off-line PCC with 7.5% in-line PCC if an addition of 2.3 kg/t of MFC and starch with milk of lime is performed according to the invention (EX1). The MFC and starch dosage levels are very low 2.3 kg/t, which means that based on these dosages the costs can be kept low, while still getting very big improvements in strength properties of the ply.

For board top ply the porosity must be kept high (in order to make possible to dry the board fast) and in this way (mixing MFC and milk of lime) one can keep MFC amount low a keep high porosity level.

EX2 shows that if MFC and starch instead are dosaged into the thick stock much higher amounts are needed for the same strength levels and the high porosity is lost. The Gurley hill porosity of 31 s/100 ml shows a low porosity of this paper ply.

The invention claimed is:

1. An in-line production method for providing a hybrid material for a ply for a board, the method comprising the following steps:

(i) providing a liquid flow of carbon dioxide and milk of lime to a target suspension of a short circulation of a fiber web machine wherein said target suspension forms a ply substrate material, and wherein the target suspension comprises at least one of the following components: virgin pulp suspension, recycled pulp suspension, additive suspension and solids-containing filtrate; and (ii) providing a suitable amount of a microfibrillated cellulose substantially simultaneously with the feeding of the liquid flow of the carbon dioxide and milk of lime, said carbon dioxide and milk of lime reacting to form calcium carbonate precipitated onto or into said microfibrillated cellulose, wherein the hybrid material comprises said calcium carbonate precipitated onto or into fibers of said microfibrillated cellulose and/or fibrils of said microfibrillated cellulose.

2. The method as claimed in claim 1, wherein the feeding into the short circulation is performed by injecting at least either carbon dioxide, lime milk and/or microfibrillated cellulose into the target suspension of the liquid flow of the paper making stock.

3. The method as claimed in claim 1, wherein the carbon dioxide, lime milk and/or microfibrillated cellulose are fed separately by injection.

4. The method as claimed in claim 1, wherein the microfibrillated cellulose is provided in the liquid flow of a paper making stock and the lime milk and carbon dioxide are fed separately or simultaneously by injection.

5. The method as claimed in claim 1, wherein the microfibrillated cellulose is mixed with other optional additives and the mixture is fed separately from the feeding of lime milk and carbon dioxide.

6. The method as claimed in claim 1, wherein the injection into the liquid flow of a paper making stock is performed from one or more nozzles in a direction substantially transverse to the direction of the liquid flow, and at a flow rate that is higher than that of the liquid flow.

7. The method as claimed in claim 1, wherein the ply comprises the hybrid material in an amount of 1 to 25 wt-%.

8. The method as claimed in claim 1, wherein the ply comprises the hybrid material in an amount of 1 to 15 wt-%.

* * * * *